US010244872B2

(12) United States Patent
Thomson et al.

(10) Patent No.: US 10,244,872 B2
(45) Date of Patent: Apr. 2, 2019

(54) HEIGHT-ADJUSTABLE CHILD SUPPORT DEVICE

(71) Applicant: KIDS II, INC., Atlanta, GA (US)

(72) Inventors: John Matthew Thomson, Johns Creek, GA (US); Yuk Tong Poon, Yuen Long (HK); Stephen R. Burns, Cumming, GA (US)

(73) Assignee: KIDS II, INC., Atlanta, GA (US)

( * ) Notice: Subject to any disclaimer, the term of this patent is extended or adjusted under 35 U.S.C. 154(b) by 454 days.

(21) Appl. No.: 15/078,234

(22) Filed: Mar. 23, 2016

(65) Prior Publication Data

US 2016/0286977 A1 Oct. 6, 2016

Related U.S. Application Data

(60) Provisional application No. 62/139,974, filed on Mar. 30, 2015, provisional application No. 62/152,845, filed on Apr. 25, 2015.

(51) Int. Cl.

| | |
|---|---|
| ***A47D 1/00*** | (2006.01) |
| ***A47D 1/10*** | (2006.01) |
| ***A47D 13/10*** | (2006.01) |

(52) U.S. Cl.

CPC ..... *A47D 1/004* (2013.01); *A47D 1/008* (2013.01); *A47D 1/10* (2013.01); *A47D 13/107* (2013.01)

(58) Field of Classification Search

CPC ..... A47D 1/004; A47D 1/008; A47D 1/10; A47D 13/107

USPC ..... 297/274

See application file for complete search history.

(56) References Cited

U.S. PATENT DOCUMENTS

| | | | |
|---|---|---|---|
| 16,150 | A | 12/1856 | Robbins |
| 616,697 | A | 12/1898 | Cowles et al. |
| 1,057,360 | A | 3/1913 | Patten |
| 1,104,609 | A | 7/1914 | Blain |
| 1,204,249 | A | 11/1916 | Condon, Jr. |
| 1,326,921 | A | 1/1920 | Dzimitowicz |
| 1,428,039 | A | 9/1922 | Kratz |
| 1,950,042 | A | 3/1934 | Upper |
| 2,606,593 | A | 8/1952 | Beurskens |
| 4,743,008 | A | 5/1988 | Fermaglich et al. |
| 4,900,011 | A | 2/1990 | Nolet |
| 4,948,120 | A | 8/1990 | Krueger et al. |
| 5,080,383 | A | 1/1992 | Hsieh |
| 5,201,693 | A | 4/1993 | Sparkes |
| 5,288,283 | A | 2/1994 | Meeker |
| 5,382,033 | A | 1/1995 | Cheu |
| 5,407,246 | A | 4/1995 | Meeker et al. |
| 5,433,682 | A | 7/1995 | Fermaglich et al. |
| 5,458,550 | A | 10/1995 | Braim et al. |
| 5,499,949 | A | 3/1996 | Heubl |
| 5,688,211 | A | 11/1997 | Myers |

(Continued)

*Primary Examiner* — Anthony D Barfield

(74) *Attorney, Agent, or Firm* — Gardner Groff Greenwald & Villanueva, PC

(57) ABSTRACT

A child support device is provided with a height that is easily adjustable. The child support device includes a seat assembly suspended from at least one upright frame member extending above the seat assembly by at least one support member. The upright frame member includes a cap through which the support member is threaded. The height of the seat assembly is vertically adjustable by repositioning engagement of the support member with the at least one upright frame member.

25 Claims, 10 Drawing Sheets

(56) References Cited

U.S. PATENT DOCUMENTS

| | | | |
|---|---|---|---|
| 5,690,383 | A | 11/1997 | Meeker |
| 5,700,201 | A | 12/1997 | Bellows et al. |
| 5,816,983 | A | 10/1998 | Dawes et al. |
| 5,857,944 | A | 1/1999 | Cone et al. |
| 5,876,311 | A | 3/1999 | Coates et al. |
| 5,934,747 | A | 8/1999 | Garland |
| 5,947,875 | A | 9/1999 | Cone et al. |
| 6,000,750 | A | 12/1999 | Rossman et al. |
| 6,299,247 | B1 | 10/2001 | Meeker et al. |
| 6,817,864 | B1 | 11/2004 | Martinez |
| 6,854,799 | B1 | 2/2005 | Asbach et al. |
| 6,932,709 | B1 | 8/2005 | Gubitosi et al. |
| 6,994,630 | B2 | 2/2006 | Paesang |
| 7,025,364 | B1 | 4/2006 | Clarke |
| 7,044,892 | B2 | 5/2006 | Stern et al. |
| 7,438,644 | B2 | 10/2008 | Gubitosi et al. |
| 7,472,964 | B2 | 1/2009 | King |
| 7,523,984 | B2 | 4/2009 | Steininger |
| 7,614,979 | B2 | 11/2009 | Thomson et al. |
| 7,727,076 | B2 | 6/2010 | Bapst et al. |
| 7,740,560 | B2 | 6/2010 | Tadin et al. |
| D650,207 | S | 12/2011 | Soriano et al. |
| D650,208 | S | 12/2011 | Soriano et al. |
| 8,070,617 | B2 | 12/2011 | Barron et al. |
| 8,182,355 | B2 | 5/2012 | Bapst et al. |
| 8,267,803 | B2 | 9/2012 | Trapp et al. |
| 8,303,033 | B2 | 11/2012 | Lundeen |
| 8,308,239 | B2 | 11/2012 | Lundeen |
| D675,454 | S | 2/2013 | Soriano et al. |
| D685,197 | S | 7/2013 | Soriano et al. |
| 8,556,349 | B2 | 10/2013 | Welch et al. |
| 8,845,441 | B2 | 9/2014 | Trapp et al. |
| 8,944,514 | B2 | 2/2015 | Tadin et al. |
| 8,968,110 | B2 | 3/2015 | Bapst et al. |
| 8,979,662 | B2 | 3/2015 | Rogers et al. |
| 9,010,711 | B2 | 4/2015 | Pleiman et al. |
| 9,198,547 | B2 | 12/2015 | Ondaatje et al. |
| 9,204,733 | B2 | 12/2015 | Welch et al. |
| 2008/0012409 | A1 | 1/2008 | Chen et al. |
| 2008/0194389 | A1 | 8/2008 | Southerland |
| 2011/0012408 | A1 | 1/2011 | Lee et al. |
| 2013/0072081 | A1 | 3/2013 | Goszewski |
| 2013/0093227 | A1 | 4/2013 | Mendes et al. |
| 2013/0306826 | A1* | 11/2013 | Pleiman ..... A47B 81/00 248/423 |

* cited by examiner

HEIGHT-ADJUSTABLE CHILD SUPPORT DEVICE

CROSS-REFERENCE TO RELATED APPLICATION

This application claims the benefit of U.S. Provisional Patent Application Ser. No. 62/139,974 filed Mar. 30, 2015, and U.S. Provisional Patent Application Ser. No. 62/152,845 filed Apr. 25, 2015, the entireties of which are hereby incorporated herein by reference for all purposes.

TECHNICAL FIELD

The present invention relates generally to the field of children's accessories, and more particularly to an entertainer, bouncer, jumper or other infant or child seat or support providing adjustment of a support height.

BACKGROUND

Various children's entertainer seats or supports such as bouncers or jumpers are known. A typical bouncer or jumper type of entertainer seat includes a frame having a base member adapted to rest on a support surface and support members extending from the base, and a seat tray portion suspended from the frame by straps or resilient members, allowing an infant to sit or bounce within the perimeter of the frame.

Children of different sizes may be better accommodated by entertainers having different support heights. Likewise, as a child grows taller they may be better accommodated by a higher support height. While some entertainer seats may provide for a measure of adjustment, it has been found that many known entertainer seats lack a sufficient range of adjustment, and/or do not provide sufficient ease of adjustment. Accordingly, it can be seen that needs exist for a child entertainment seat that is easily height-adjustable and that provides a substantial range of height adjustment of the support position. It is to the provision of a child entertainment seat meeting these and other needs that the present invention is primarily directed.

SUMMARY

Example embodiments of the present invention provide a child support device having a height adjustment mechanism for adjusting the height of a seat assembly. The child support device can be, for example, an entertainer, jumper, bouncer, or the like. The seat assembly includes a seat tray portion suspended from at least one upright frame member extending above the seat tray portion by at least one resilient or elastic support member. In example embodiments, the height adjustment of the seat tray is actuated at an elevation above the seat tray, for ease of access and adjustment, and provides a significant range of height adjustment. In further example embodiments, the upright frame member includes a cap through which the resilient or elastic support member is threaded. In example embodiments, the height of the seat tray portion is vertically adjustable by varying a length of the support member extending between the cap and the seat tray. In other example embodiments, the height of the seat tray portion is vertically adjustable by varying an attachment position of the support member on the upright frame member, or alternatively by varying the elevation of the point of attachment of the upright frame member with the support member.

In one aspect, the distal end of the resilient or elastic member includes a coupling component adapted to engage with a receiving component located on the upper portion of the upright frame member. The coupling component on the resilient or elastic member may include a tab, and the receiving component on the upright frame member may include a plurality of receiving sites, each site including a notch or slot. By varying which notch or slot on the upper frame member the tab on the resilient or elastic member is engaged with, a caregiver can adjust a height of the seat tray.

In another aspect, the upper portion of the upright frame member includes a coupling component adapted to engage with a receiving component on the distal end of the resilient or elastic member. The coupling component on the upright frame member may include a fixed hook, and the receiving components on the resilient or elastic member may include a series of receiving sites, each site including a loop. By varying which loop on the resilient or elastic member the hook on the upright frame member is engaged with, a caregiver can adjust a height of the seat tray.

In another aspect, the invention relates to an child support device including a base member adapted to rest on a support surface, at least one upright frame member ascending from the base member, and a cap with a guiding channel therethrough arranged at an upper end of the at least one upright frame member. The child support device preferably also includes a seat tray suspended from the at least one upright frame member, and at least one elastic support member extending through the guiding channel of the cap, having a first end attached to the seat tray and a second end configured for repositionable engagement with the at least one upright frame member to adjust a height of the seat tray portion relative to the support surface.

In another aspect, the invention relates to a height-adjustable child entertainer including a frame having a base adapted to support the height-adjustable child entertainer on a support surface, and a plurality of generally upright frame members extending upwardly from the base. The height-adjustable child entertainer preferably also includes a seat tray including a seat for positioning a child therein, and a plurality of support members supporting the seat tray suspended from the generally upright frame members. Each of the support members preferably includes a first end attached to the seat tray and a second end including a repositionable point of contact with a corresponding one of the plurality of generally upright frame members. Selective repositioning of the repositionable point of contact of the support members with the upright frame members provides adjustment of a height of the seat tray relative to the support surface.

In still another aspect, the invention relates to a method of selectively adjusting a height of a seat tray of a child entertainer seat between a plurality of different height positions relative to a support surface. The method preferably includes selectively positioning a point of contact of a support member of the child entertainer with an upright frame member of the child entertainer at one of a plurality of positions, with each of the plurality of positions corresponding to a different height position of the seat tray.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
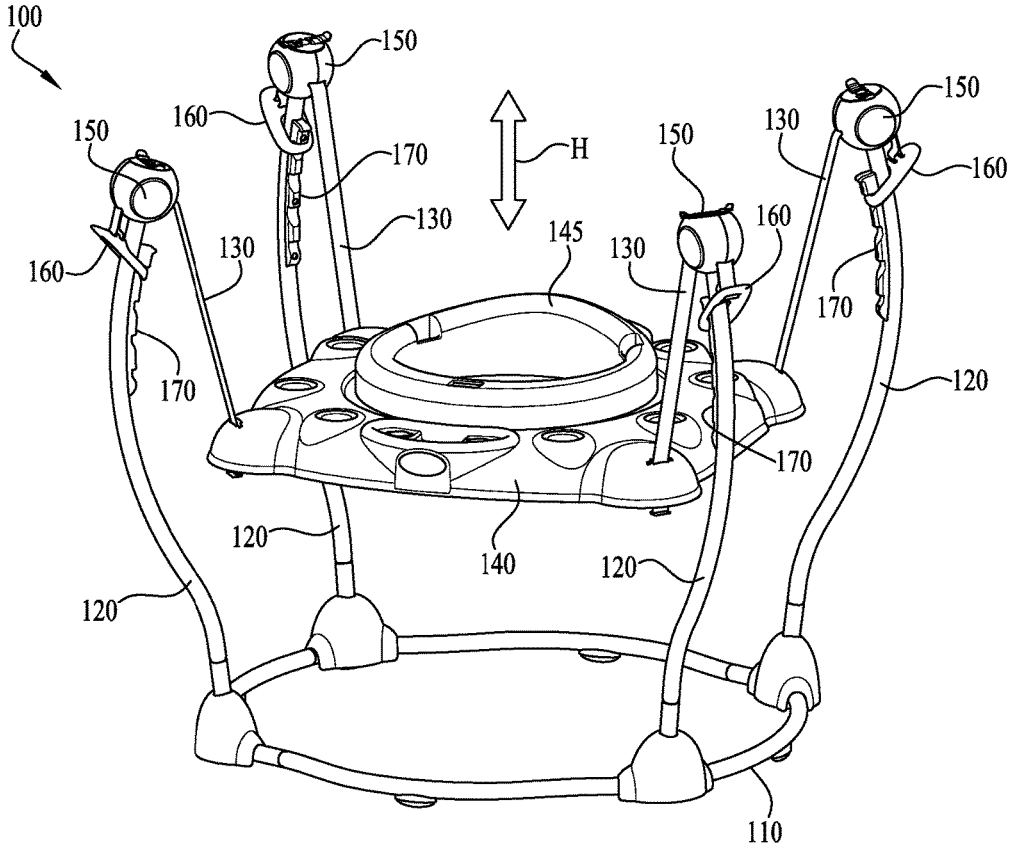
FIGS. 1A-1K illustrate a height-adjustable child support device, and details of components of the height-adjustable device, according to an example embodiment of the present invention.
Figure 1B:
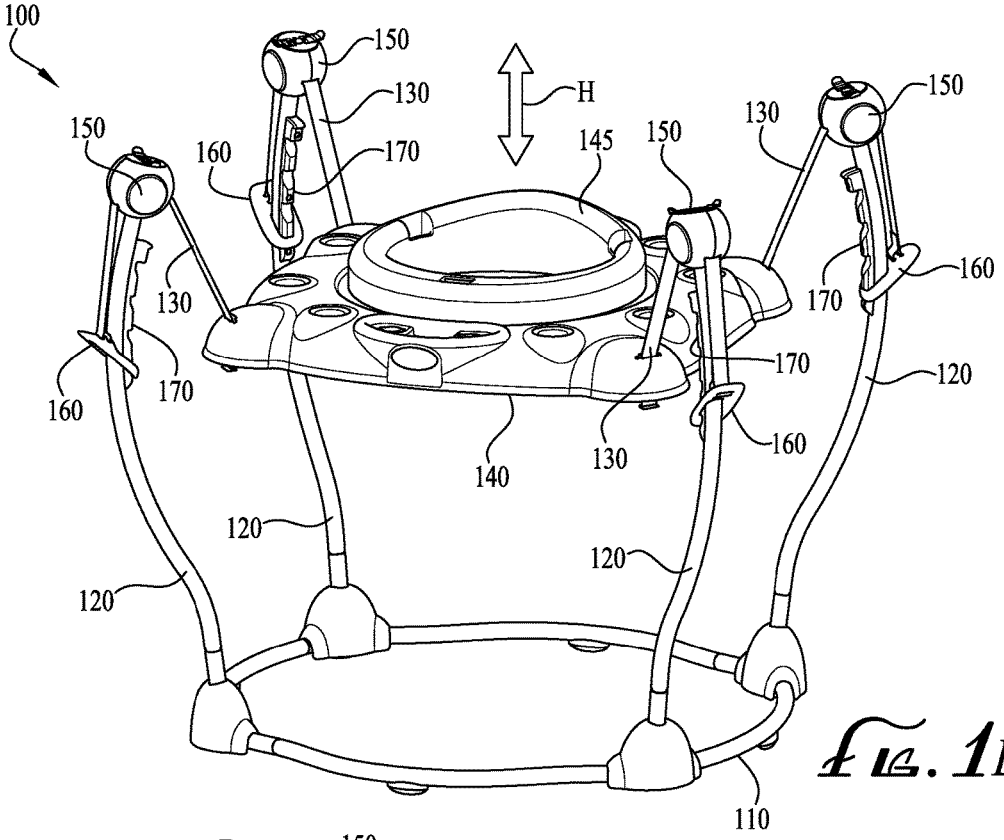
Figure 1C:
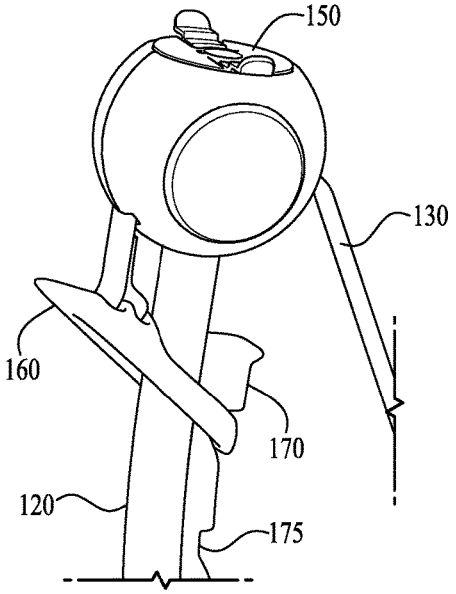
Figure 1D:
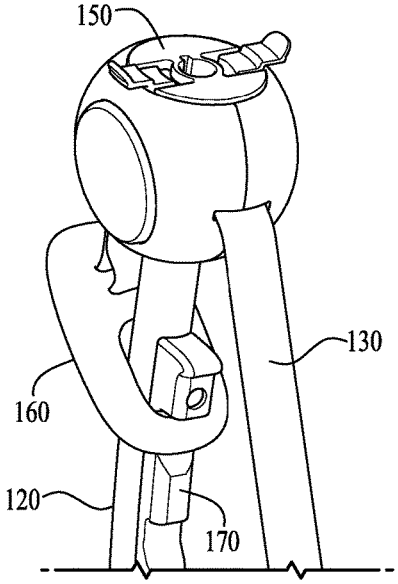
Figure 1E:
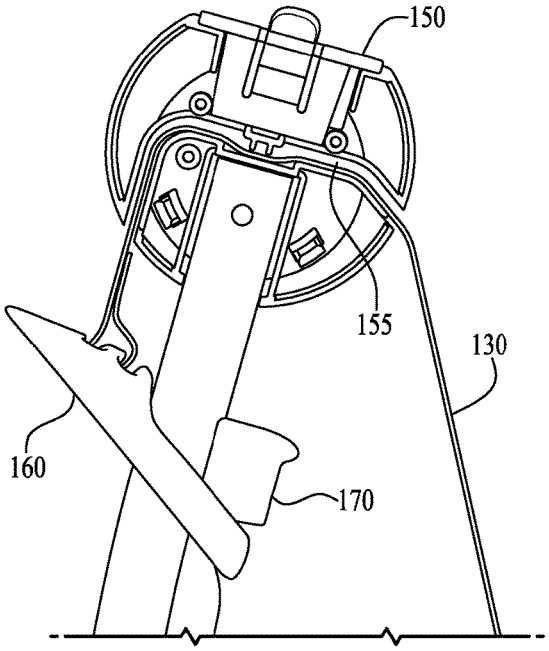
Figure 1F:
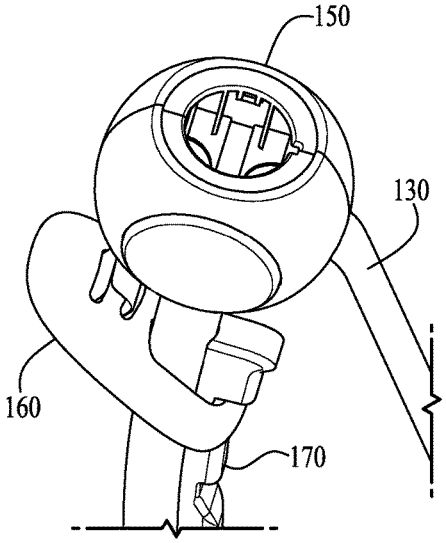

With reference now to the drawing figures, wherein like reference numbers represent corresponding parts throughout the several views, FIGS. 1A-1K illustrate a height-adjustable child support device 100 according to a first example embodiment of the present invention. As shown in FIGS. 1A and 1B, the child support device 100 includes a base member 110 that is adapted to rest on a support surface, e.g., the floor. The child support device also includes upright frame members 120 ascending from the base member 110. In example embodiments, the base 110 comprises a generally ring-shaped assembly defining a generally circular, square, rectangular or polygonal periphery, and the uprights 120 are radiused or tapered, for example tapering generally outwardly at lower portions proximal the base and back inwardly at upper portions near their top free ends. Connection hubs are optionally provided to attach the uprights 120 at spaced locations about the base 110. Support members 130 are movably coupled to the upright frame members 120. Although four support members 130 and four upright frame members 120 are shown for illustrative purposes, it should be appreciated that there may be any number of support members 130 and corresponding upright frame members 120. The support members 130 described with respect to this embodiment and other embodiments described herein can take the form of bungee cords, rubber straps, springs, or other elastic elements; or alternatively can comprise lengths of rope, cord or other flexible material with or without elasticity.

Figure 1G:
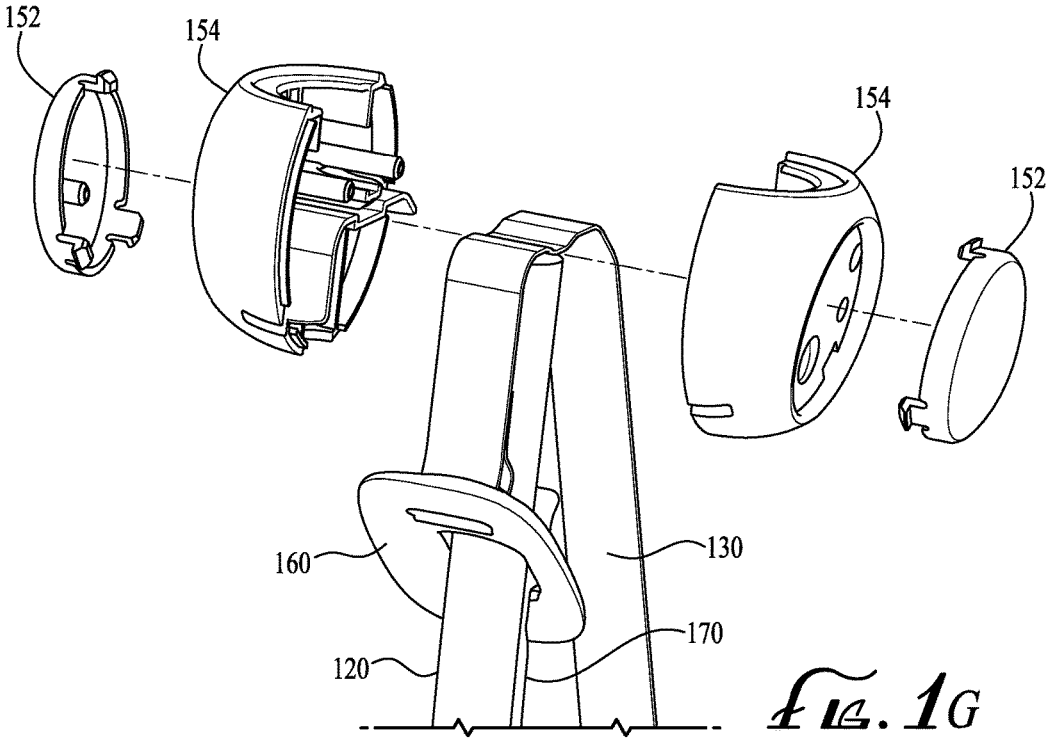

The child support device includes a seat assembly including a seat tray 140 and a seat 145 having a pair of openings for receiving an infant's or child's legs when an infant or child is arranged in the seat and an entertainment tray surrounding the seat. In example embodiments, the seat 145 is positioned in an opening generally centrally in the seat tray 140, and the legs of a child supported in the seat extend though the seat openings allowing the child's feet to contact the ground or other support surface. In this manner, the child can jump and bounce within the child support device 100, with the resilience of support members 130 providing an entertaining oscillation or bouncing motion. The seat tray 140 optionally comprises one or more child entertainment features, such as for example a toy, a character, a mobile, a motion device, an electronic audiovisual device, a sound-generating device, a light, a cup-holder, a rattle, a grasping element, a teether, or the like. Optionally, the seat 145 for receiving and positioning a child therein is rotationally mounted to the seat tray 140, so that the child can turn to face different directions while seated therein. Alternatively, the tray 140 can rotate about the seat 145. For example, the tray 140 could comprise a stationary bottom tray which the support members 130 may be coupled to and a rotatable upper tray. The seat tray 140 is suspended from the frame members 120 by the support members 130 extending above the seat tray. A height of the seat tray 140 is vertically adjustable (direction arrow H) by moving a position of one or more of the straps 130 with respect to a corresponding upright frame member 120. FIG. 1A shows the seat tray 140 in a lower position, and FIG. 1B shows the seat tray in a higher position The uppermost end of each upright frame member 120 includes a cap member 150. As shown in detail in FIGS. 1C, 1D, 1E, and 1F the cap member 150 includes a guiding channel 155 extending therethrough. A distal end of the support member 130 ascends from the seat tray 140 and can be threaded to emerge in a downward direction with respect to the cap 150. As shown in FIG. 1G, the cap portion 150 includes detachable or removable components 152 and 154, allowing access for threading of the support member 130 through the guiding channel 155 during assembly. The distal end of each support member 130 includes a coupling component 160 attached thereto. As shown in FIGS. 1B, 1C, 1D, 1E, the coupling component 160 is adapted to engage with a receiving component 170 located on the upper portion of the upright frame member 120.

Figure 1H:
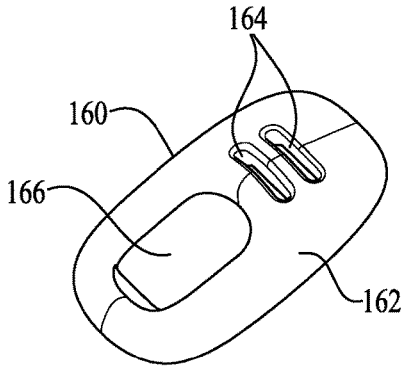
Figure 1I:
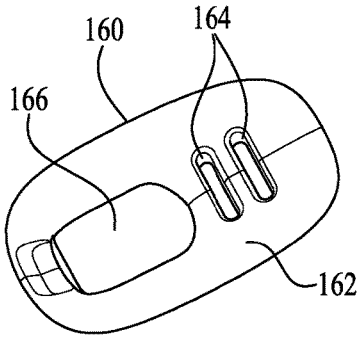
Figure 1J:
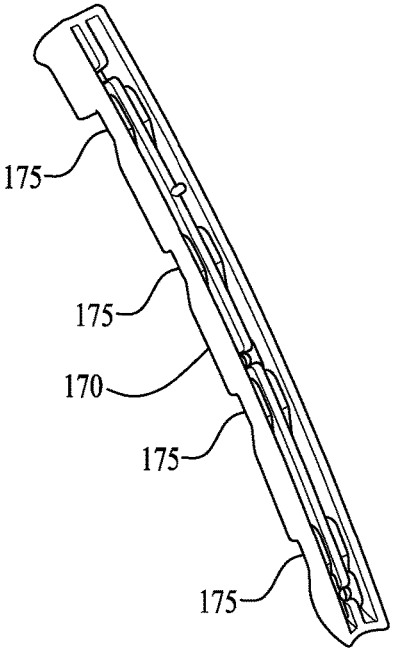
Figure 1K:
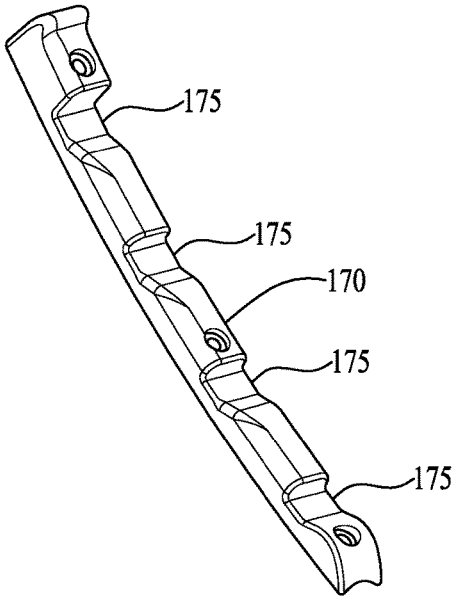

The coupling component 160 is shown in more detail in FIGS. 1H and 1I. As shown in these figures, the coupling component 160 may include a tab 162 with a pair of smaller transverse slots 164 through which a support member 130 is threaded, and a larger axially extending slot 166 configured to fit over an upright frame member 120 and allow the coupling component to slide up and down along the upright frame member. The receiving component 170 is shown in more detail in FIGS. 1J and 1K. The receiving component 170 can be mounted to or integrally formed with the upper portion of the upright frame member 120. The receiving component 170 can have a plurality of receiving sites, each presenting a different height or length. Each receiving site includes a notch (or slot) 175, and the tab 162 on coupling component 160 is adapted to engage with the notch. As shown in FIG. 1A, positioning the coupling component 160 of the support member 130 into engagement in a higher notch 175 of the receiving component 170 allows a longer length of the support member 130 to extend between the cap 150 and the seat tray 140, positioning the seat tray in a lowered position closer to the floor or other support surface, for example to use with a smaller child. And as shown in FIG. 1B, positioning the coupling component 160 of the support member 130 into engagement in a lower notch 175 of the receiving component 170 retracts the support member 130 resulting in a shorter length of support member extending between the cap 150 and the seat tray 140, positioning the seat tray in a raised or elevated position further from the floor or other support surface, for example to use with a larger child.

In the embodiment of FIGS. 1A-1K, tension from the weight of the seat 145 (and a child supported therein) and the seat tray 140 retains the tab of the coupling component 160 in the notch of the receiving component to maintain the position of the seat tray 140 at a selected height adjustment. The coupling component 160 optionally toggles or pivots under load, about a fulcrum at the point of engagement with a notch 175 of the receiving component 170, to more securely engage the upright support member 120 within the axial slot 166 of the coupling component. By moving the coupling component 160 upward or downward to engage with one of the receiving sites of the receiving component 170, the length of the support member 130 extending between the cap member 150 and the seat tray 140 can be varied, thereby adjusting the height of the seat tray 140. In the depicted embodiment, the height adjustment components (coupling component 160 and receiving component 170) extend and retract the support members 130 to adjust the height of the seat tray 140 from positions above (i.e., at a higher elevation) the seat tray, and can be easily accessed and operated from a position on the exterior of the upright frame members 120 opposite the seat tray. While the seat tray 140 may in some instances be positioned at an elevation above the position of the coupling component(s) 160 and/or a portion of the receiving component(s) 170, the engagement of the support members 130 through the caps 150 or otherwise engaged at or around upper portions of the upright frame members 120 adjusts the height from a position above the seat tray.

Figure 2A:
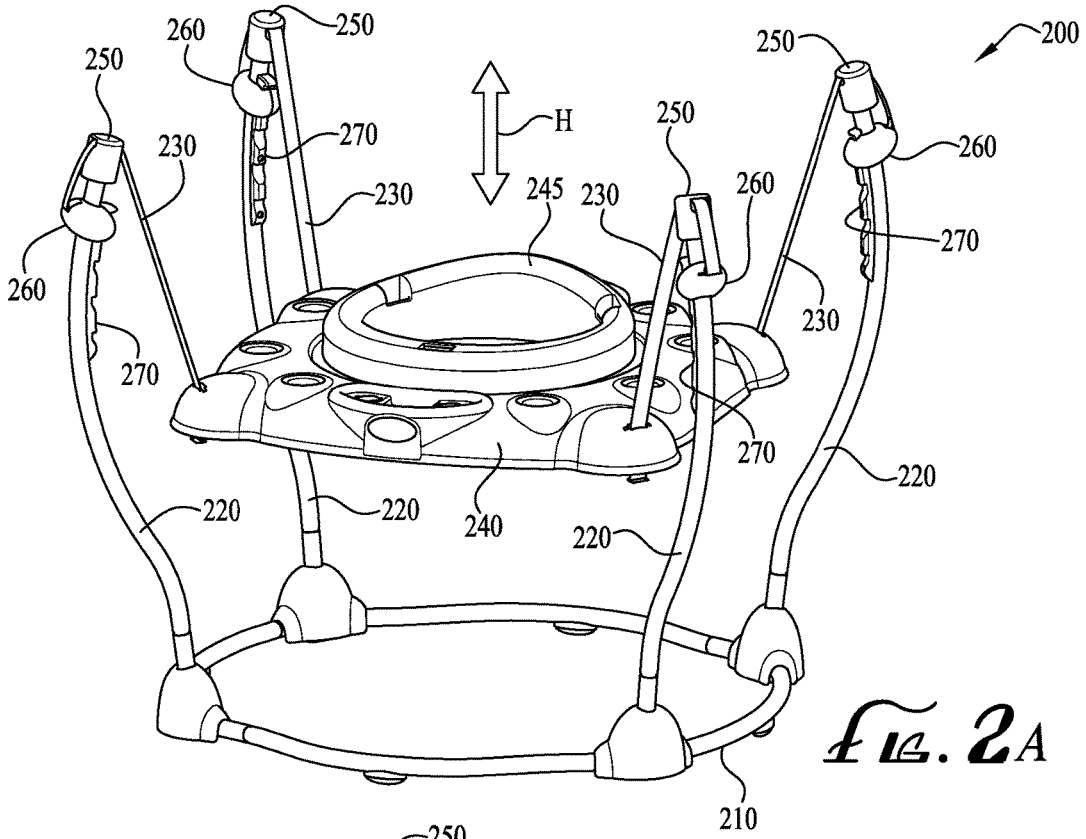
FIG. 2A-2C illustrate a height-adjustable child support device, and details of components of the height-adjustable device, according to another example embodiment of the present invention.
Figure 2B:
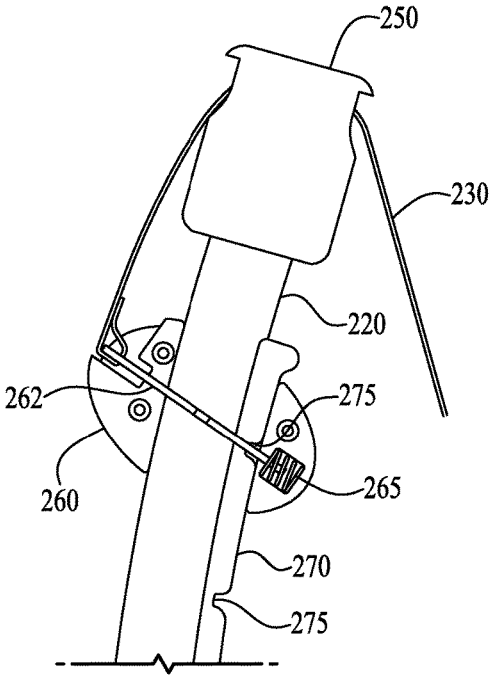
Figure 2C:
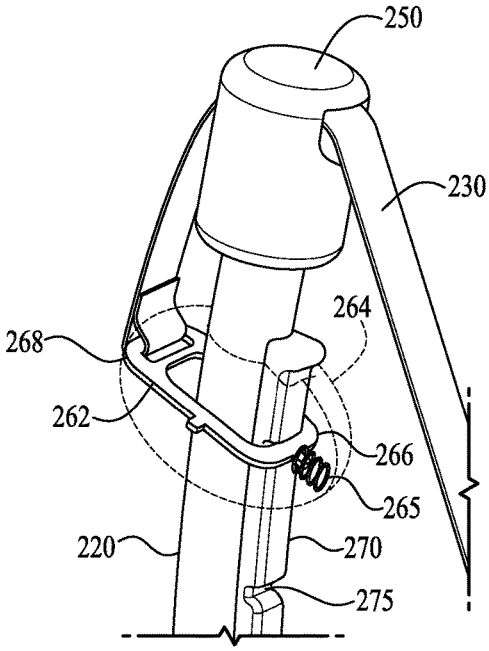

FIGS. 2A-2C illustrate a child support device 200 according to a second example embodiment. The child support device 200 shown in FIG. 2A is similar to that shown in FIG. 1A, in that it includes a base portion 210, upright frame members 220 extending therefrom, support members 230 coupled to the upright frame members 220, and a seat assembly including a seat 245 and a seat tray 240 movably supported by the support members. As shown in FIGS. 2A-2C, the distal end of each upright frame member 220 includes a cap member 250 through which the support member 230 is threaded. In addition, a coupling component 260 included at a distal end of each support member 230 is adapted to engage with a receiving component 270 that is mounted to or integrally formed with the upper portion of the upright frame member 220. As shown in FIGS. 2A-2C, the receiving component 270 can have a plurality of receiving sites, each including a notch or slot 275, and each presenting a different height adjustment setting for extending or retracting the length of the support members 230 between the caps 250 and the seat tray 240. By moving the coupling component 260 upward or downward to engage with different receiving sites along the receiving component 270, the length of the support member 230 extending between the cap member 250 and the seat tray 240 is lengthened or shortened, respectively, thereby adjusting the height of the seat tray 240 lower or higher. FIGS. 2B and 2C show further detail of the coupling component 260 receiving component 270. The coupling component 260 includes a spring-biased tab member 262 or actuator housed at least partially within a shell 264, the tab member 262 having an edge 266 adapted to be received in one of the plurality of notches (or slots) 275 of the receiving component 270. When a caregiver pushes the exposed end 268 of the tab 262 member into the shell 264, the spring 265 is compressed, and the edge 266 of the tab 262 is freed from the notch 275. A caregiver can then slide the coupling component 260 up or down the upright frame member 220 and release the tab member 262 into a notch 275 of the receiving component 270 at a desired height, thereby adjusting the height of the seat tray 240.

Figure 3A:
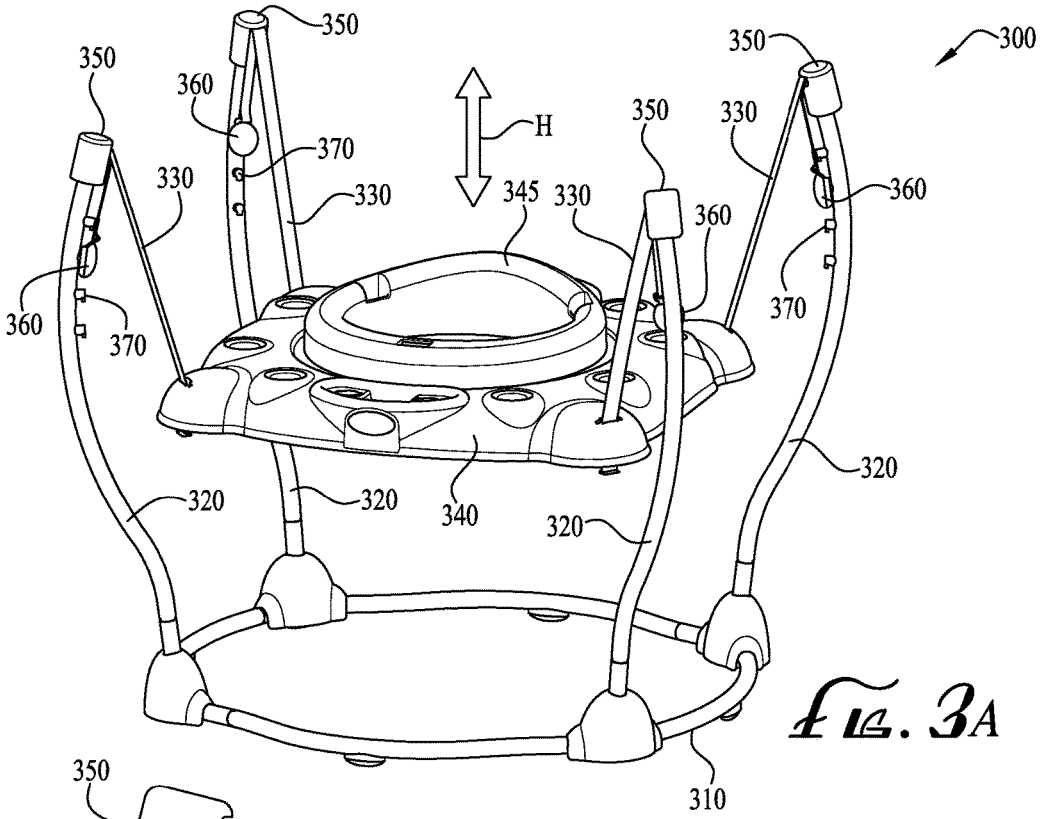
FIGS. 3A-3D illustrate a height-adjustable child support device, and details of components of the height-adjustable device, according to another example embodiment of the present invention.
Figure 3B:
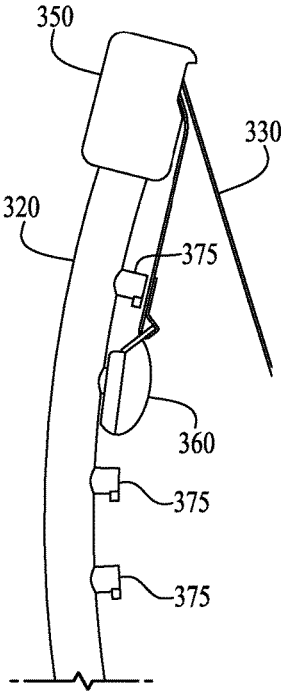
Figure 3C:
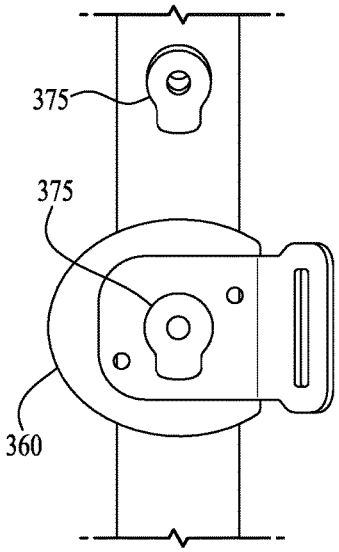
Figure 3D:
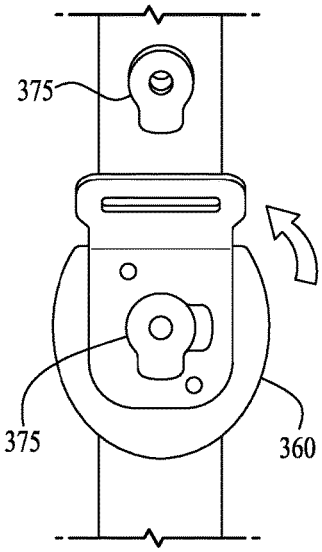

FIG. 3A shows a child support device 300 according to another example embodiment. The child support device 300 is similar to that shown in FIGS. 1A and 2A, in that it includes a base portion 310, upright frame members 320 extending therefrom, support members 330 coupled to the upright frame members 320, and a seat assembly including a seat 345 and a seat tray 340 movably supported by the support members. Also, as shown in FIGS. 3A-3C, the distal end of each upright frame member 320 includes a cap member 350 through which the support member 330 is threaded. In addition, a coupling component 360 included at a distal end of each strap 330 is adapted to engage with a receiving component 370 that is mounted to or integrally formed with the upper portion of the upright frame member 320. As shown in FIGS. 3A-3C, the receiving component 370 can have a plurality of receiving sites, each including a protuberance 375, in a spaced array along a portion of the length of each upright 320, each presenting a different height or length adjustment setting. By moving the coupling component 360 upward or downward to engage with one of the receiving sites, the length of the support member 330 extending between the cap member 350 and the seat tray 340 can be varied, thereby adjusting the height of the seat tray 340. The protuberance included at each receiving site may include a peg or hook. As shown in detail in FIGS. 3B-3D, the coupling component 360 engages one of the protuberances 375 of the receiving component 370 by fitting over the selected protuberance corresponding to a desired height setting. As further shown in FIGS. 3C and 3D, the coupling component 360 and the receiving component 370 can be configured in such a way that the coupling component 360 can disengage from the receiving component 370 only when the coupling component is turned in a certain direction, thus biasing the coupling component 360 to a "locked" position when the weight of a child or infant is applied to the seat tray 340. For example, each protuberance 375 of the receiving component 370 can comprise an irregular key shape aligned axially with the upright 320, and the coupling component 360 can comprise an opening having a corresponding irregular keyway shape aligned transversely on the coupling component, whereby the key passes through the keyway when the coupling component is turned transversely but does not pass through the keyway when turned axially. In example embodiments, the support member 330 is attached to the coupling component 360 at an axial end thereof, such that when the coupling component is released and the support member tensioned, the coupling component does not disengage from the receiving component 370.

Figure 4A:
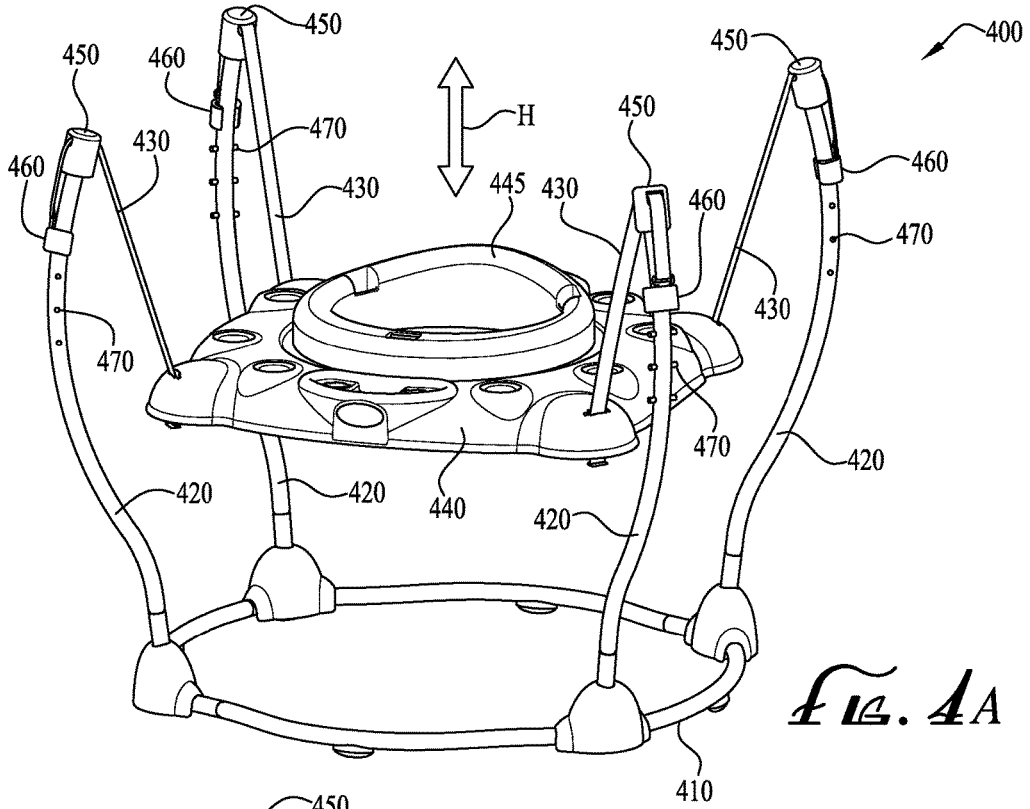
FIGS. 4A-4D illustrate a height-adjustable child support device, and details of components of the height-adjustable device, according to another example embodiment of the present invention.
Figure 4B:
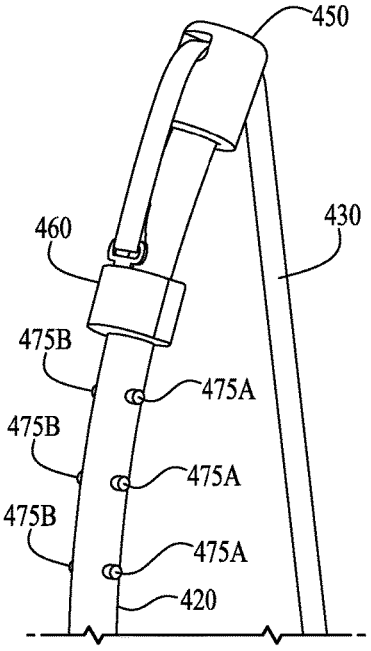
Figure 4C:
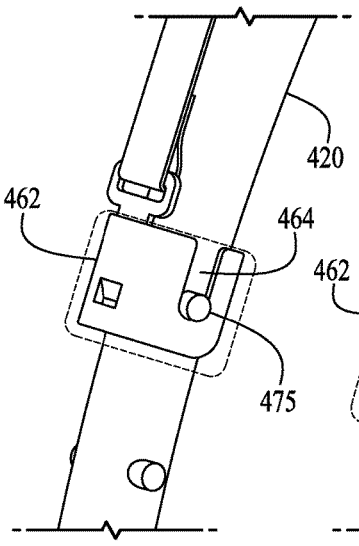
Figure 4D:
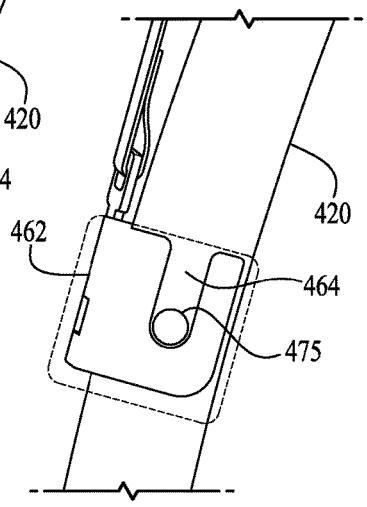

FIGS. 4A-4D show a child support device 400 according to another example embodiment. The child support device 400 is similar to that shown in FIGS. 1A, 2A, and 3A in that it includes a base portion 410, upright frame members 420 extending therefrom, support members 430 coupled to the upright frame members 420, and a seat assembly including a seat 445 and a seat tray 440 movably supported by the support members. Also, as shown in FIGS. 4A and 4B, the distal end of each upright frame member 420 includes a cap member 450 through which the support member 430 is threaded. In addition, a coupling component 460 included at a distal end of each support member 430 is adapted to engage with a receiving component 470 that is mounted to or integrally formed with the upper portion of the upright frame member 420. As shown in FIGS. 4A and 4B, the receiving component 470 can have a plurality of receiving sites, each including a pair of protuberances 475 presenting a different height setting of the seat tray 440. By moving the coupling component 460 upward or downward to engage with different receiving sites, the length of the support member 430 extending between the cap member 450 and the seat tray 440 can be varied, thereby adjusting the height of the seat tray 440. In the embodiment shown in FIGS. 4A-4D, the receiving component may include a protuberance 475, such as a peg or hook, at each receiving site, for example a pair of pegs 475A and 475B projecting outwardly from opposite sides of the upright frame member 420 at sequentially spaced heights. As shown in detail in FIGS. 4B-4D the coupling component 460 comprises a sleeve or collar 462 configured to slidingly receive the corresponding upright frame member 420, with slots 464 on opposite sides thereof which form hooks for engaging the pegs 472 of the receiving component 470.

Figure 5A:
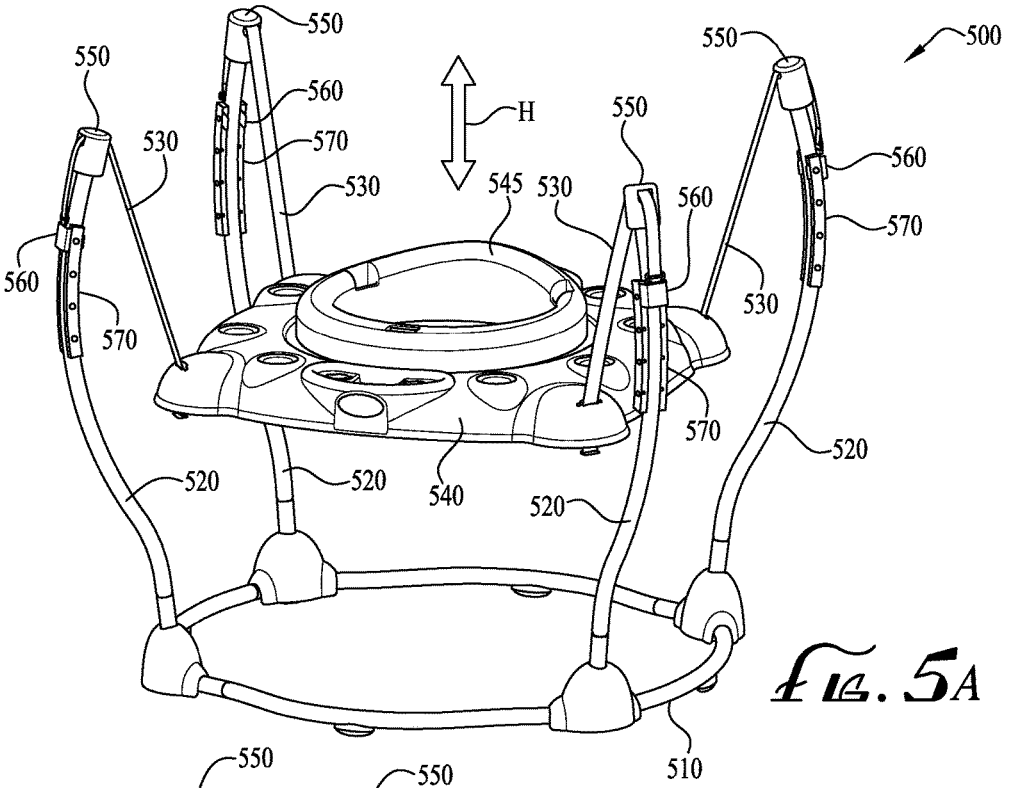
FIGS. 5A-5E illustrate a height-adjustable child support device, and details of components of the height-adjustable device, according to another example embodiment of the present invention.
Figure 5B:
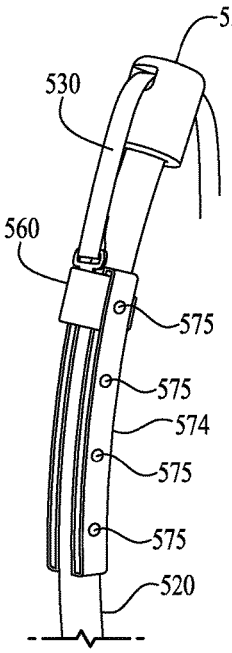
Figure 5C:
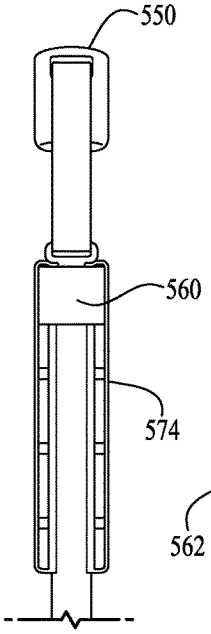
Figure 5D:
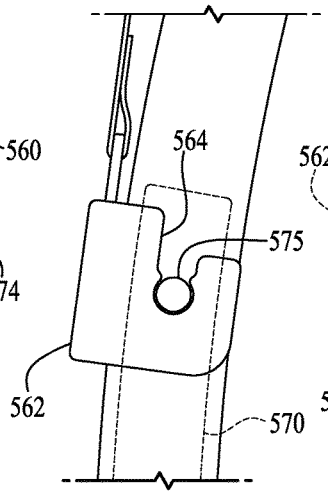
Figure 5E:
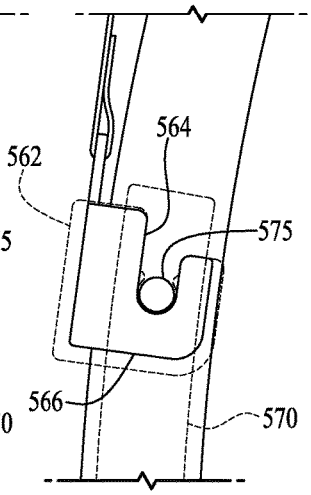

FIGS. 5A-5E show a child support device 500 according to another example embodiment. The child support device 500 is similar to that shown in the previously described embodiments, in that it includes a base portion 510, upright frame members 520 extending therefrom, support members 530 coupled to the upright frame members 520, and a seat assembly including a seat 545 and a seat tray 540 movably supported by the support members. Also, as shown in FIGS. 5A-5C, the distal end of each upright frame member 520 includes a cap member 550 through which the support member 530 is threaded. In addition, a coupling component 560 included at a distal end of each support member 530 is adapted to engage with a receiving component 570 that is mounted to or integrally formed with the upper portion of the upright frame member 520. As shown in FIGS. 5A-5C, the receiving component 570 can have a plurality of receiving sites, each including a protuberance 575, and each presenting a different height or length adjustment setting. By moving the coupling component 560 upward or downward to engage with one of the receiving sites 575, the length of the support member 530 extending between the cap member 550 and the seat tray 540 can be varied, thereby adjusting the height of the seat tray 540. In the embodiment shown in FIGS. 5A-5E, the receiving component may include a protuberance 575, such as a peg or hook, at each receiving site. As shown in detail in FIGS. 5B-5E, the receiving component 570 may include an outer flange portion 574 surrounding the protuberances 575 along sides of the upright frame members 520, and the coupling component 560 comprises a sleeve or collar 562 having slots or hooks 564 for engaging the protuberances of the receiving component 570 by hooking under or around the protuberance. As shown in FIG. 5D, the slot 564 of the coupling component 560 optionally comprises a resilient snap coupling 566 in the collar 562 for positive engagement with the protuberances of the receiving component 570.

Although illustrated and described above as being positioned on the upper portion of each the upright frame member, it should be appreciated that receiving components may be located on any portion of the upright frame member, including at medial or lower positions along the upright frame member, and are not restricted to being positioned on the upper portion.

Figure 6A:
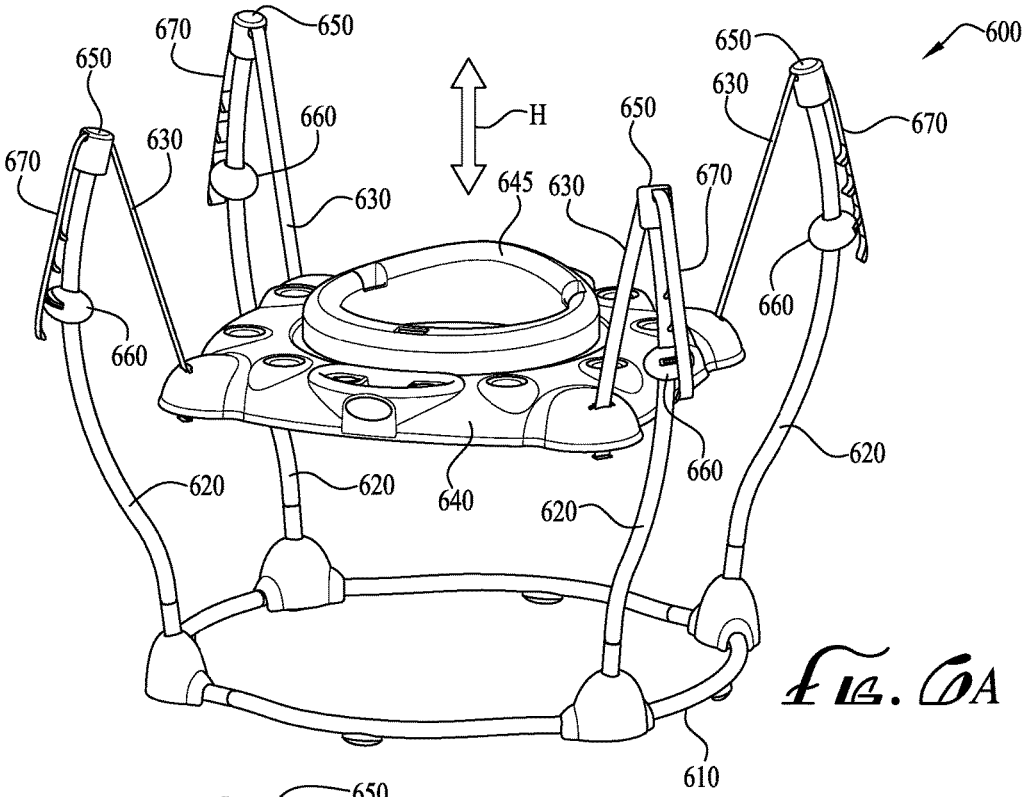
FIGS. 6A-6C illustrate a height-adjustable child support device, and details of components of the height-adjustable device, according to another example embodiment of the present invention.
Figure 6B:
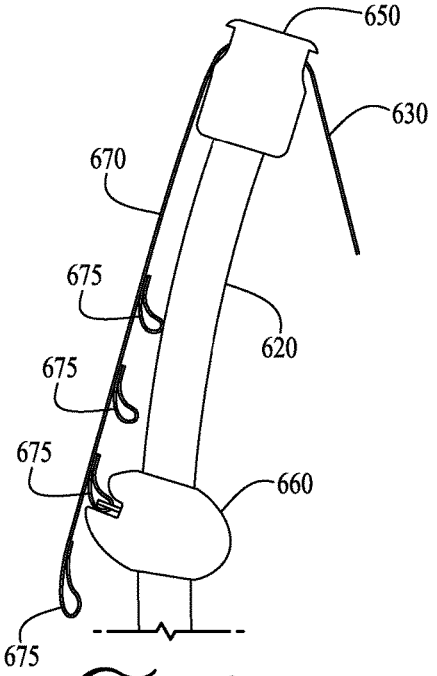
Figure 6C:
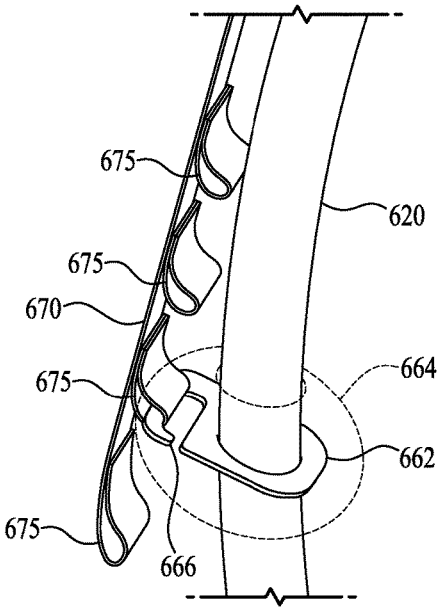

FIGS. 6A-6C show a child support device 600 according to another example embodiment. The child support device 600 is similar to those described above, in that it includes a base portion 610, upright frame members 620 extending therefrom, support members 630 coupled to the upright frame members 620, and a seat assembly including a seat 645 and a seat tray 640 movably supported by the support members. Also, as shown in FIGS. 6A and 6B, the distal end of each upright frame member 620 includes a cap member 650 through which the support member 630 is threaded. The child support device 600 also includes a coupling component 660 and a receiving component 670. The coupling components 660 are positioned a distance below the caps 650 of each upright frame member 620. Although shown as being positioned at an upper portion of the upright frame member 620, it should be appreciated that the coupling component 660 may be positioned on any portion of the upright frame member and is not restricted to being positioned on the upper portion. As shown in FIGS. 6A-6C, each coupling component 660 includes a tab 662 including a fixed hook 666 within a recess of a housing or shell 664. The coupling component 660 can be integrally formed as part of the upright frame member 620 or attached thereto. The coupling component 660 is adapted to releasably and repositionably engage with a receiving component 670 at a distal end of the support member 630. As shown in FIGS. 6A-6C, the receiving component 670 includes a plurality of receiving sites at sequentially spaced positions along the support member 630, each site comprising a loop 675 formed on the support member 630. The loops 675 may be formed as part of the support member 630 or attached thereto. Each loop 675 is adapted to engage with the coupling component 660 by hooking onto the hook 664 of a tab member 662 of the coupling component. By moving the supporting member 630 upward or downward such that different loops 675 engage with the coupling component 660, the length of the supporting member extending between the cap member 650 and the seat tray 640 can be varied, thereby adjusting the height of the seat tray 640.

Figure 7:
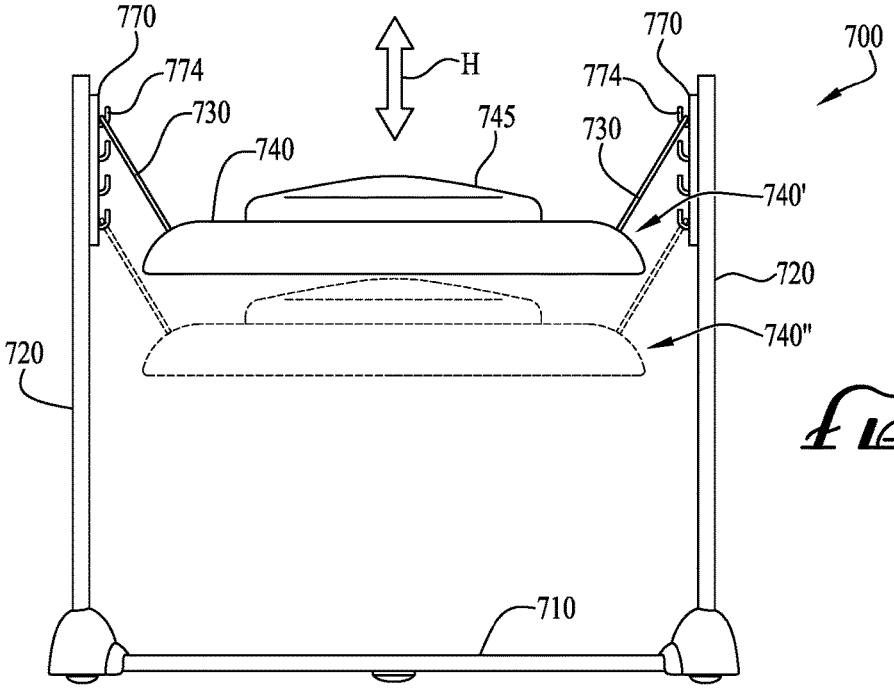
FIG. 7 shows a side view of a height-adjustable child support device according to another example embodiment of the present invention.

FIG. 7 shows another example embodiment of a child support device 700 according to an example embodiment of the invention. The child support device 700 includes a frame having a base 710 and a plurality of uprights 720. Support members 730, which may include, e.g., elastic support members or straps, suspend and support a seat assembly including a seat 745 and a seat tray 740 from a plurality of support couplings 770 located toward the upper portion free ends of each upright 720. In the depicted embodiment, the plurality of support couplings 770 comprise a spaced array of hooks or connectors 764 to which a loop or other connecting feature (not shown in detail for simplicity of illustration) of the supporting member 730 can releasably couple. Coupling the support member 730 to an upper one of the plurality of support couplings 770 positions the seat tray 740 at a higher position 740' as shown in solid lines, while coupling the support member 730 to a lower one of the plurality of support couplings positions the seat tray 740 at a lower position 740" as shown in broken lines, thereby allowing selective height adjustment of the child support device 700 as indicated by direction arrow H.

Figure 8:
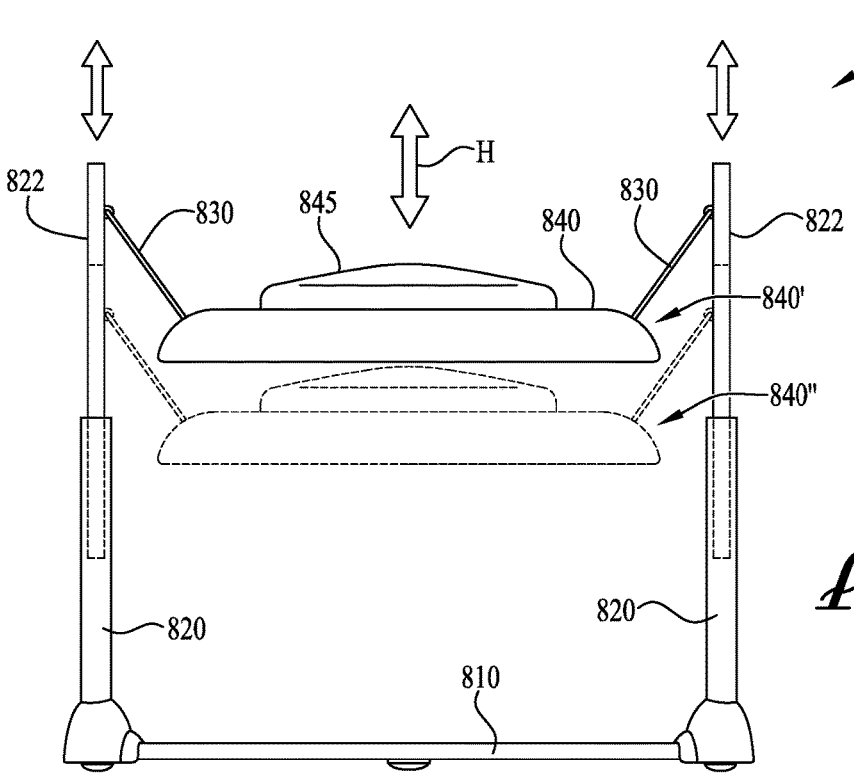
FIG. 8 shows a side view of a height-adjustable child support device according to another example embodiment of the present invention.

FIG. 8 shows another example embodiment of a child support device 800 according to an example embodiment of the invention. The child support device 800 includes a frame having a base 810 and a plurality of uprights 820. Support members 830, which may include, e.g., elastic support members or straps, suspend and support a seat assembly including a seat 845 and a seat tray 840 from attachment points adjacent the upper portion free ends of each upright 820. In the depicted embodiment, the uprights 820 include telescoping or otherwise extensible upper members 822 that can be raised and lowered to a plurality of different heights to selectively position the seat tray 840 at a higher position 840' as shown in solid lines, or at a lower position 840" as shown in broken lines, thereby allowing height adjustment of the child support device 800 as indicated by direction arrow H.

In another aspect of the invention, in any of its various embodiments, the child support device enables a method of allowing an adult caregiver to selectively adjust the height of the seat tray or other child support between two or more different elevations or height positions relative to the floor, ground or other support surface. In example embodiments, the method of the present invention comprises selectively positioning a point of contact of a support member of the child support device with an upright frame member of the child support device, at one of a plurality of positions, each of the plurality of positions corresponding to a different height or elevation of the seat tray. The point of contact of the support member with the upright frame member can be varied by repositioning a coupling component attached to the support member relative to a receiving component of the upright frame member, for example to vary the effective length of the portion of the support member extending between the upright frame member and the seat tray, thereby adjusting the height of the seat tray. For example, the support member can be extended or retracted by passing a middle portion of the support member through a passage in a cap at or near the top of the upright frame member and affixing a distal end of the support member at a selected position on the upright frame member, to selectively position the proximal end of the support member which is attached to the seat tray. Alternatively, the point of contact of the support member with the upright frame member can be varied by repositioning the point of attachment of the support member up or down on the upright frame member. In still other alternate embodiments, the point of contact of the support member with the upright frame member can be varied by repositioning at least an upper end portion of the upright frame member that contacts or attaches with the support member up or down. In example embodiments, the height adjustment is actuated by repositioning one or more features of the child support device located at an elevation above the seat tray, for example at or adjacent the upper portions of the upright frame members.

Various changes and modifications to such a height adjustment device, beyond those explicitly mentioned herein, are contemplated as being within the scope of the present invention. For example, while the receiving components and coupling components have been variously described as notches, slots, protuberances and hooks, it should be appreciated that any fastening and retaining methods known in the industry may be used. While the invention has been described with reference to example embodiments, it will be understood by those skilled in the art that a variety of modifications, additions, and deletions are within the scope of the invention. The particular configurations and objectives described herein are merely exemplary and are in no way limiting.

While the invention has been described with reference to preferred and example embodiments, it will be understood by those skilled in the art that a variety of modifications, additions and deletions are within the scope of the invention, as defined by the following claims.

What is claimed is:

1. A child support device, comprising:

a base member adapted to rest on a support surface;

at least one upright frame member ascending from the base member;

a cap with a guiding channel therethrough arranged at an upper end of the at least one upright frame member;

a seat assembly suspended from the at least one upright frame member;

at least one support member extending through the guiding channel of the cap and having a first end attached to the seat assembly and a second end configured for repositionable engagement with the at least one upright frame member to adjust a height of the seat assembly relative to the support surface; and a coupling component located on the second end of the at least one support member and a receiving component mounted to or integrally formed with an upper portion of the at least one upright frame member, wherein the receiving component defines a plurality of receiving sites, each corresponding to a different height adjustment of the seat assembly, wherein the height of the seat assembly is adjusted by engaging the coupling component with a selected one of the receiving sites;

wherein the receiving sites of the receiving component include at least one of notches and slots;

wherein the coupling component comprises a tab member adapted to be received in one of the notches or slots.

2. The child support device of claim 1, wherein the tab member is spring-biased and housed at least partially within a shell.

3. The child support device of claim 1, wherein the seat assembly includes a seat and a seat tray.

4. The child support device of claim 1, wherein the supporting member includes an elastic or resilient strap.

5. A height-adjustable child support device, comprising:

a frame comprising a base adapted to support the height-adjustable child support device on a support surface, and a plurality of generally upright frame members extending upwardly from the base;

a seat assembly comprising a seat for positioning a child therein; and a plurality of support members supporting the seat assembly suspended from the generally upright frame members, each of the support members having a first end attached to the seat assembly and a second end comprising a repositionable point of contact with a corresponding one of the plurality of generally upright frame members, whereby selective repositioning of the repositionable point of contact of the support members with the upright frame members provides adjustment of a height of the seat assembly relative to the support surface;

wherein the repositionable point of contact of the support members with the upright frame members is positioned above the seat assembly.

6. The height-adjustable child support device of claim 5, wherein the plurality of support members comprise elastic straps.

7. The height-adjustable child support device of claim 5, further comprising a cap at a top end of each of the plurality of generally upright frame members, each cap comprising a passage through which a corresponding one of the plurality of support members passes.

8. The height-adjustable child support device of claim 5, wherein each of the plurality of generally upright frame members comprises an extensible member, and wherein the repositionable point of contact comprises a connection point of the support member with the extensible member of a corresponding one of the generally upright frame members.

9. The height-adjustable child support device of claim 5, wherein the seat assembly includes a seat and a seat tray.

10. A method of selectively adjusting a height of a seat assembly of a child support device between a plurality of different height positions relative to a support surface, the method comprising selectively positioning a point of contact of a support member of the child support device with an upright frame member of the child support device at one of a plurality of positions, each of the plurality of positions corresponding to a different height position of the seat assembly, the method further comprising repositioning one or more features of the child support device located at an elevation above the seat assembly.

11. The method of claim 10, wherein the step of selectively positioning a point of contact of a support member of the child support device with an upright frame member comprises positioning a coupling component attached to the support member relative to a receiving component of the upright frame member.

12. The method of claim 10, further comprising passing a medial portion of the support member through a passage in a cap on the upright frame member and affixing a distal end of the support member at a selected position on the upright frame member to selectively position a proximal end of the support member which is attached to the seat assembly.

13. The method of claim 10, wherein the step of selectively positioning a point of contact of a support member of the child support device with an upright frame member comprises repositioning the point of attachment of the support member up or down on the upright frame member.

14. The method of claim 10, wherein the step of selectively positioning a point of contact of a support member of the child support device with an upright frame member comprises repositioning at least an upper end portion of the upright frame member that contacts or attaches with the support member up or down.

15. The method of claim 10, wherein the seat assembly includes a seat and a seat tray.

16. A child support device, comprising:

a base member adapted to rest on a support surface;

at least one upright frame member ascending from the base member;

a cap with a guiding channel therethrough arranged at an upper end of the at least one upright frame member;

a seat assembly suspended from the at least one upright frame member;

at least one support member extending through the guiding channel of the cap and having a first end attached to the seat assembly and a second end configured for repositionable engagement with the at least one upright frame member to adjust a height of the seat assembly relative to the support surface; and a coupling component located on the second end of the at least one support member and a receiving component mounted to or integrally formed with an upper portion of the at least one upright frame member, wherein the receiving component defines a plurality of receiving sites, each corresponding to a different height adjustment of the seat assembly, wherein the height of the seat assembly is adjusted by engaging the coupling component with a selected one of the receiving sites;

wherein the receiving sites of the receiving component include protuberances including at least one of pegs and hooks;

wherein the coupling component is adapted to hook onto the one of protuberances.

17. The child support device of claim 16, wherein the coupling component is adapted to fit over one of the protuberances.

18. The child support device of claim 17, wherein the coupling component and the receiving component are configured such that the coupling component is disengagable from the receiving component only when the coupling component is turned in a certain direction, thus biasing the coupling component in a locked position when the weight of an infant or child is applied to the seat assembly.

19. A child support device, comprising:

a base member adapted to rest on a support surface;

at least one upright frame member ascending from the base member;

a cap with a guiding channel therethrough arranged at an upper end of the at least one upright frame member;

a seat assembly suspended from the at least one upright frame member;

at least one support member extending through the guiding channel of the cap and having a first end attached to the seat assembly and a second end configured for repositionable engagement with the at least one upright frame member to adjust a height of the seat assembly relative to the support surface; and a coupling component mounted to or integrally formed with an upper portion of the at least one upright frame member and a receiving component located on a distal end of the at least one support member, wherein the receiving component has a plurality of receiving sites, each presenting a different height or length, and the height of the seat assembly is adjustable by engaging the coupling component with one of the receiving sites;

wherein the coupling component includes a fixed hook.

20. The child support device of claim 19, wherein the receiving sites of the receiving component include loops.

21. A height-adjustable child support device, comprising:

a frame comprising a base adapted to support the height-adjustable child support device on a support surface, and a plurality of generally upright frame members extending upwardly from the base;

a seat assembly comprising a seat for positioning a child therein; and a plurality of support members supporting the seat assembly suspended from the generally upright frame members, each of the support members having a first end attached to the seat assembly and a second end comprising a repositionable point of contact with a corresponding one of the plurality of generally upright frame members, whereby selective repositioning of the repositionable point of contact of the support members with the upright frame members provides adjustment of a height of the seat assembly relative to the support surface;

wherein each of the upright frame members comprises a receiving component defining a plurality of receiving sites, each receiving site corresponding to a different adjustment of the height of the seat assembly relative to the support surface, and wherein the repositionable point of contact of the support members comprises a coupling component selectively engageable with one of the plurality of receiving sites of the receiving component;

wherein the coupling component comprises a spring-biased coupling element for engagement with the receiving component.

22. The height-adjustable child support device of claim 21, wherein a weight of the seat assembly applies a force to the plurality of support members to provide engagement of the coupling component with the receiving component.

23. The height-adjustable child support device of claim 21, wherein the coupling component is movable between a first orientation allowing engagement and disengagement with the receiving component, and a second orientation preventing engagement and disengagement with the receiving component.

24. A height-adjustable child support device, comprising:

a frame comprising a base adapted to support the height-adjustable child support device on a support surface, and a plurality of generally upright frame members extending upwardly from the base;

a seat assembly comprising a seat for positioning a child therein; and a plurality of support members supporting the seat assembly suspended from the generally upright frame members, each of the support members having a first end attached to the seat assembly and a second end comprising a repositionable point of contact with a corresponding one of the plurality of generally upright frame members, whereby selective repositioning of the repositionable point of contact of the support members with the upright frame members provides adjustment of a height of the seat assembly relative to the support surface;

wherein the repositionable point of contact comprises a plurality of loops on each of the support members, each loop selectively engageable with a hook extending from a corresponding one of the plurality of generally upright frame members.

25. A height-adjustable child support device, comprising:

a frame comprising a base adapted to support the height-adjustable child support device on a support surface, and a plurality of generally upright frame members extending upwardly from the base;

a seat assembly comprising a seat for positioning a child therein; and a plurality of support members supporting the seat assembly suspended from the generally upright frame members, each of the support members having a first end attached to the seat assembly and a second end comprising a repositionable point of contact with a corresponding one of the plurality of generally upright frame members, whereby selective repositioning of the repositionable point of contact of the support members with the upright frame members provides adjustment of a height of the seat assembly relative to the support surface;

wherein the repositionable point of contact comprises a loop on each of the support members, each loop selectively engageable with a selected one of a plurality of hooks extending from each of the plurality of generally upright frame members.

* * * * *